United States Patent [19]

Seaberg

[11] 4,185,944

[45] Jan. 29, 1980

[54] SLIDE STRUCTURE FOR PARALLEL ARM CLAMPS AND THE LIKE

[75] Inventor: Richard D. Seaberg, Vancouver, Wash.

[73] Assignee: Cascade Corporation, Portland, Oreg.

[21] Appl. No.: 920,455

[22] Filed: Jun. 29, 1978

[51] Int. Cl.[2] ..... B66F 9/18

[52] U.S. Cl. ..... 414/621; 414/671

[58] Field of Search ..... 214/650 R, 651, 652, 214/653, 731; 294/67 BB, 88; 414/618, 619, 620, 621, 668, 671

[56] References Cited

U.S. PATENT DOCUMENTS

| | | | |
|---|---|---|---|
| 2,671,571 | 3/1954 | Gerhardt | 214/653 |
| 2,782,065 | 2/1957 | Lord | 214/731 X |
| 2,821,316 | 1/1958 | Saint | 214/653 |
| 2,874,862 | 2/1959 | Farmer et al. | 214/653 X |
| 3,203,567 | 8/1965 | Huitfeldt | 214/652 |
| 3,245,562 | 4/1966 | Horton | 214/653 |

*Primary Examiner*—L. J. Paperner
*Attorney, Agent, or Firm*—Chernoff & Vilhauer

[57] ABSTRACT

A slide structure for lift truck mounted parallel arm clamps, fork positioners and the like. A slide guide frame adapted to be mounted on the load carriage of the lift truck carries a plurality of elongate, transversely movable horizontal slide members for mounting opposed, openable and closable load arms. Each slide member has an elongate rear portion extending along the length thereof which fits inside a respective guide, and an elongate front portion, also extending substantially along the length of the slide member, which is always external of the guide and to which the clamp arm or other load arm may be attached directly. Each slide member is characterized in that it has substantially no abrupt cross-sectional changes in its horizontal dimension throughout its length, while having markedly nonuniform vertical dimensions along its length such that the front portion of each slide member is quite narrow vertically through the majority of its length but extends both upward and downward at one end so as to form an enlarged section having a vertical surface for the attachment of a load arm at such end. The enlarged end sections of the front portions of respective adjacent slide members are at opposite ends of the adjacent slide members so that the narrow front section of one slide member is juxtaposed vertically with the enlarged front section of the adjacent slide member creating a vertically nested relationship between adjacent slide members throughout their entire range movement.

15 Claims, 5 Drawing Figures

SLIDE STRUCTURE FOR PARALLEL ARM CLAMPS AND THE LIKE

BACKGROUND OF THE INVENTION

This invention relates to improvements in load-handling attachments for lift trucks wherein selectively openable and closable opposed load arms (i.e. clamp arms, laterally positionable forks or other load-engaging implements) are attached to the ends of transversely oriented, horizontally movable elongate slide members mounted on a slide guide frame attached to a lift truck load carriage.

In the past, stress concentrations have been responsible for a high incidence of fatigue failures at the joint between the rear of a forwardly protruding load arm and the end of the respective slide member upon which the load arm is mounted. Such failures result from the cyclic application of primarily horizontal forces to the joint, caused by the load moment and clamping moment respectively. The load moment is the reactive moment exerted about a generally horizontal axis transverse of the lift truck by the weight of the forwardly protruding load, causing the load arm to pull forwardly away from the truck at its top and push rearwardly toward the truck at its bottom. The clamping moment is the reactive moment exerted about a generally vertical axis by the clamping pressure on the load which tends to pivot the load arm laterally outward with respect to the end of the respective slide member upon which it is mounted.

In conventional structures utilizing tube-type slide guides, as shown for example in Ehmann U.S. Pat. No. RE 23,694, each slide member includes a metal connecting member of small cross section and length, compared to the cross section and length of the remainder of the slide member, protruding forwardly at one end of the slide member and attaching at its forward end to the rear of a load arm. The relatively small cross section and length, and the forward protrusion, of the connecting member is necessary because such member must communicate between the interior and exterior of the tube-type slide guide, through a narrow slot in the guide, when the load arms are closed to a narrow position within the width of the clamp guide frame. This type of construction, which is also utilized in structures having tube-type guides of square or rectangular shape as shown for example in U.S. Pat. Nos. 2,609,114 and 2,746,630, introduces a high degree of susceptibility to failure from the above-described cyclically applied horizontal forces because the protruding connecting member at the end of each slide member causes a relatively abrupt cross-sectional change horizontally in the slide member at the point where the connecting member protrudes, thereby creating a stress concentration at that point. Moreover, the forwardly protruding nature of such connecting member provides an additional lever arm through which the horizontal reactive clamping forces can act on the stress concentration point, thereby maximizing the size of the clamping moment acting on the stress concentration point.

Some previous clamps have sought to remedy the above-described susceptibility to fatigue failure from cyclic horizontal forces by providing large horizontally extending gussets at the juncture between the slide member and load arm, as shown for example in U.S. Pat. Nos. 2,635,774, 2,870,929 and 2,956,700. However such gussets interfere with the handling of a rectangular load in the optimum position where the rear surface of the load is closely adjacent to the slide guide frame. Attempting to hold a rectangular load in a more forward position where it does not interfere with the gussets is unsatisfactory since the greater forward tipping moment thus exerted by the load on the lift truck greatly reduces the load-carrying capacity and stability of the truck.

Still other clamp constructions have attempted to solve the aforementioned failure problem by providing slide members of uniform cross section throughout their length, each having an elongate portion along the front thereof which is exterior of the slide guide and to which the load arm may attach directly without the necessity of any protruding connecting member. In one such construction, the tube-type guide and slide construction previously described is reversed such that the tube serves as the movable slide member and is slidably mounted over an interior guide on the slide guide frame. In another analogous construction, horizontally oriented channels having open fronts are utilized as the guides, the slides constituting horizontally oriented, elongate I-beams having their rear flanges riding within the respective channels and their front flanges projecting forwardly and exterior of the front of the channels. In these constructions, where the slide members each contain a longitudinal front portion extending along the length thereof which is exterior to the guide, there is no need for a forwardly protruding connecting member at the end of the slide member for attachment to the load arm, but rather the load arm may be connected directly to the longitudinal front portion of the slide member thereby eliminating any abrupt horizontal change in cross section of the slide member and eliminating the additional lever arm for clamping forces characteristic of those clamps having tube-type slotted guides.

Unfortunately, although the latter clamp constructions improve the resistance to failure of the joint between the end of the slide member and rear of the load arm, they also maximize the overall vertical height of the clamp since the large front portions of the respective slide members occupy a common vertical plane and must pass one another in that plane when the clamp is closed to a narrow position. Accordingly the slide members must be spaced apart vertically sufficiently such that no part of their respective front portions which occupy the same vertical plane overlap vertically, which would otherwise cause interference between adjacent slide members when the clamp is closed to a narrow position. Such vertical spacing makes it very difficult to achieve a clamp which also has a low vertical height; however low vertical height is extremely important when loading to the ceiling in a boxcar or other low ceiling area where the clamp guide frame frequently strikes the ceiling before the load can be lifted into place.

Accordingly, what is needed is a slide structure which minimizes the aforementioned stress concentration and susceptibility to failure at the joint between the load arm and the slide, but which is also capable of producing a minimal overall vertical height of the clamp structure.

SUMMARY OF THE PRESENT INVENTION

The present invention satisfies the foregoing combined needs by utilizing slide members having an elongate rear portion extending along the length thereof which fits inside a guide, and an elongate front portion also extending substantially along the length of the slide member which is always external of the guide and to which the load arm may be attached directly with no need for a forwardly protruding connecting member. The fact that the front portion of each slide member extends at least through a major portion of the length of the slide member eliminates any abrupt change in cross section of the slide member in the horizontal direction and thereby eliminates the usual stress concentration point which is typically susceptible to horizontal forces from cyclic load moments and clamping moments.

Since the respective elongate front portions of adjacent slide members occupy a common vertical plane, and yet must pass each other without interference to achieve narrow closed positions of the load arms, the front portions must be capable of clearing one another vertically. However, in order to satisfy the second requirement of minimizing the overall vertical height of the structure, which is determined by the vertical space required for the slide members, the invention contemplates that the front portions of the slide members which occupy a common vertical plane overlap one another vertically so as to minimize the vertical separation between the slide members. These two, seemingly conflicting features are rendered compatible by recognition of the fact that substantial changes in slide member cross section in a vertical direction can be tolerated without causing susceptibility to failure, even though substantial changes in cross section in the horizontal direction cannot. This is due to the fact that the horizontal forces from the clamping and load moments constitute the principal loading at the ends of the slide members, rather than vertical forces due to the weight of the load. Accordingly the present invention features a cross section of each slide member which has markedly nonuniform vertical dimensions along its length but substantially no abrupt changes in horizontal dimension throughout its length, such that the front portion of each slide member is quite narrow vertically through the majority of its length but extends both upward and downward at one end so as to form an enlarged vertical surface, preferably of greater vertical dimension than that of the rear portion of the slide member, for the attachment of a load arm at such end. The enlarged end sections of the front portions of respective adjacent slide members overlap vertically with respect to one another; however the enlarged sections are at opposite ends of the adjacent slide members so that the narrow front section of one slide member is juxtaposed with the enlarged front end section of the adjacent slide member creating a vertically nested relationship between adjacent slide members throughout the entire range of their movement, especially at a very narrow closed position of the load arms. The vertical nesting of the elongate front portions of adjacent slide members enables the overall height of the clamp structure to be minimized while preserving the desired wide range of open and closed positions of the load arms both within and beyond the width of the slide guide frame, despite the provision of the elongate front portions of the slide members exterior of the slide guides to which the load arms may be attached without causing stress concentrations susceptible to horizontal forces.

Accordingly it is a primary objective of the present invention to provide an improved slide structure for lift truck load-handling attachments which minimizes stress concentrations and susceptibility to failure from horizontal forces at the joint between the load arm and slide while also minimizing the overall vertical height of the structure.

The foregoing and other objectives, features, and advantages of the invention will be more readily understood upon consideration of the following detailed description of the invention, taken in conjunction with the accompanying drawings.

DESCRIPTION OF THE PREFERRED EMBODIMENT

Figures 1, 5:
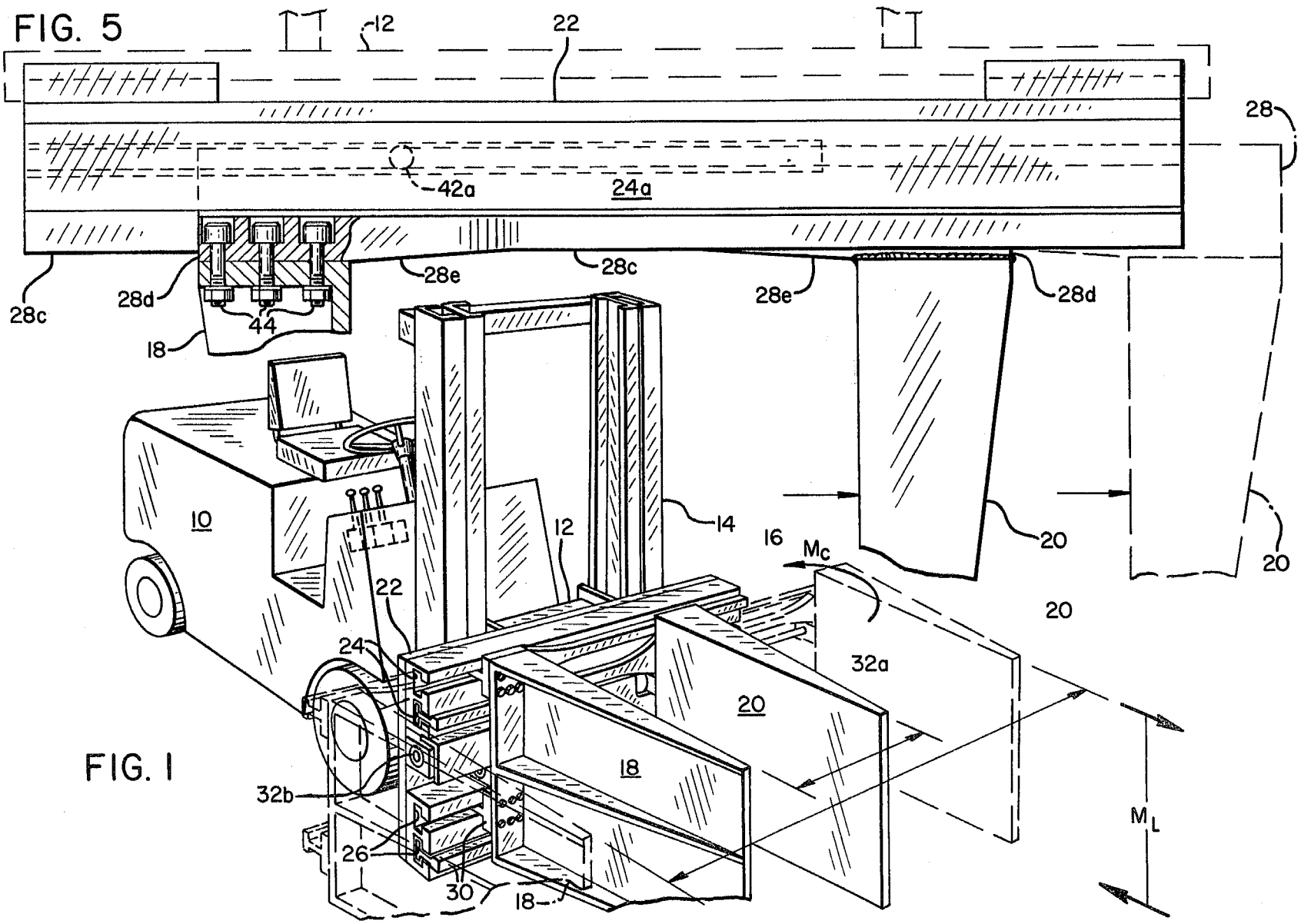
FIG. 1 is a perspective view showing a lift truck having an exemplary embodiment of the slide structure of the present invention mounted thereon, with forwardly protruding clamp arms mounted upon the slide structure.
FIG. 5 is a partially sectional top view of the slide structure of FIG. 2, illustrating two alternate methods by which the clamp arms may be attached to the slide structure.

With reference to FIG. 1, a typical lift truck 10 is shown having a selectively elevatable load carriage 12 mounted on a mast 14 at the front of the lift truck. A slide structure, indicated generally as 16, is mounted on the load carriage 12 so as to reciprocate vertically therewith. The slide structure 16 has a pair of forwardly protruding, transversely openable and closable load arms 18 and 20 mounted thereon, such load arms being depicted for sake of illustration as clamp arms for cartons and other generally rectilinear loads. The load arms might alternatively be arcuate for handling cylindrical loads, constitute laterally positional load forks, or be of any other configuration appropriate for handling a load.

The slide structure 16 comprises a slide guide frame 22, mounted vertically on the load carriage 12, having upper and lower pairs 24 and 26 respectively of elongate, parallel, vertically spaced transverse slide guides thereon. Each pair of slide guides 24 and 26 mounts a respective pair 28 or 30 of elongate, parallel, vertically spaced mutually adjacent slide members. Each slide member of a pair is longitudinally movably mounted within a respective slide guide so as to be movable with respect to the guides alternately away from or toward the other slide member of the pair in a mutually overlapping longitudinal relationship. As shown in FIG. 1, each slide member of a respective pair 28 or 30 has a respective one of the load arms 18 and 20 rigidly mounted to one end thereof in a manner to be described more fully hereafter, the slide members being movable toward or away from one another such that the ends mounting the load arms are within the width of the slide guide frame 22 as shown in solid lines in FIG. 1 or, alternatively, exterior of the width of the slide guide frame 22 as shown in phantom. This range of movement is necessary to enable the load-handling apparatus to engage loads of greatly varying width. It will be noted that the upper slide members of the respective pairs 28 and 30 have their respective load arm-mounting ends in vertical alignment on one side of the slide structure such that the load arm 18 is attached to both slide members, and both therefore move in unison. Similarly, the respective load arm-mounting ends of the lower slide members of the pairs 28 and 30 respectively are in vertical alignment on the opposite side of the slide structure and have the other load arm 20 attached thereto such that the lower slide members also move in unison with one another. A reactive load moment $M_L$ and clamping moment Mc result from the handling of a load by the load arms 18 and 20.

Figure 2:
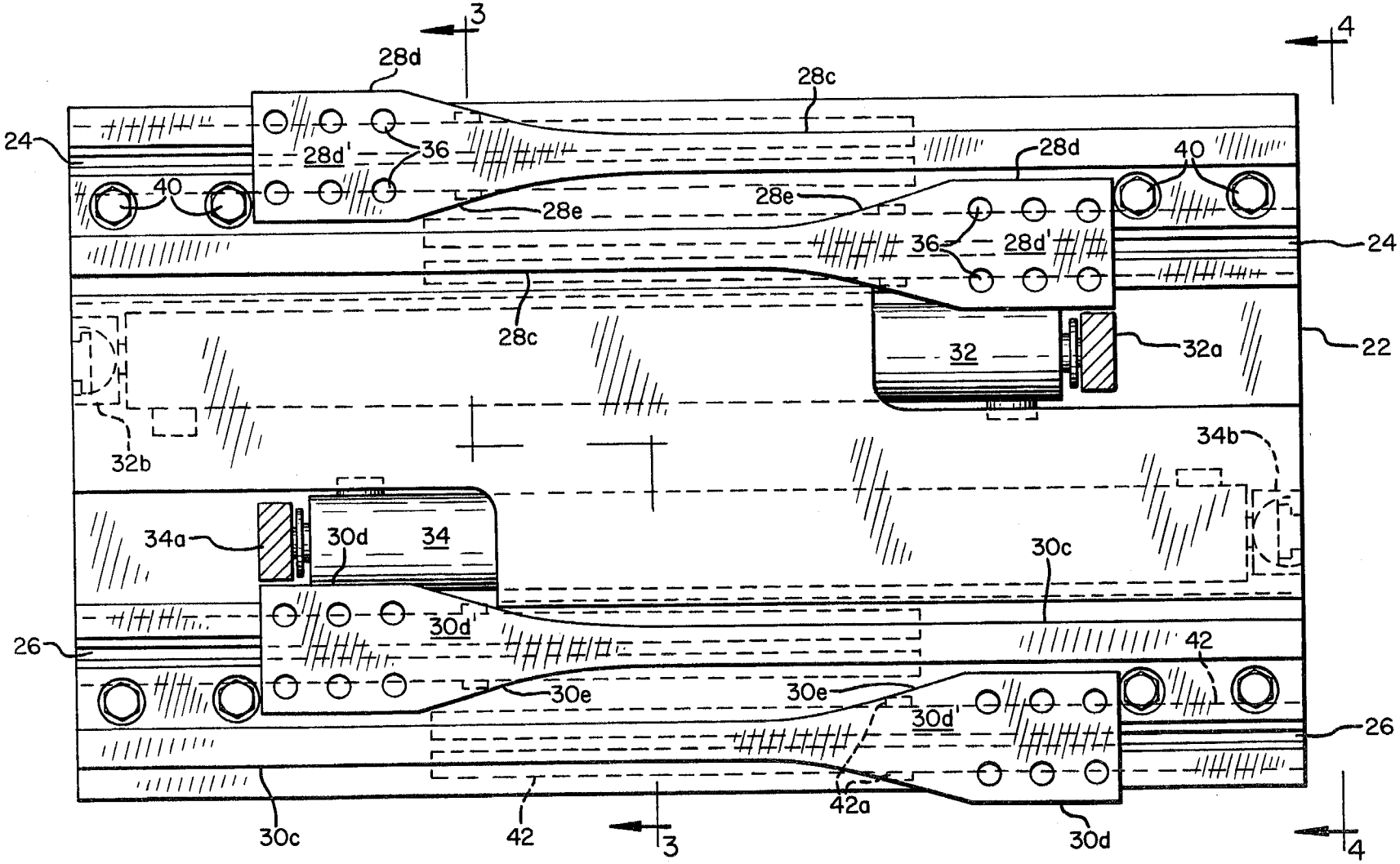
FIG. 2 is an enlarged front view of the slide structure of FIG. 1 with the clamp arms removed.
Figure 4:
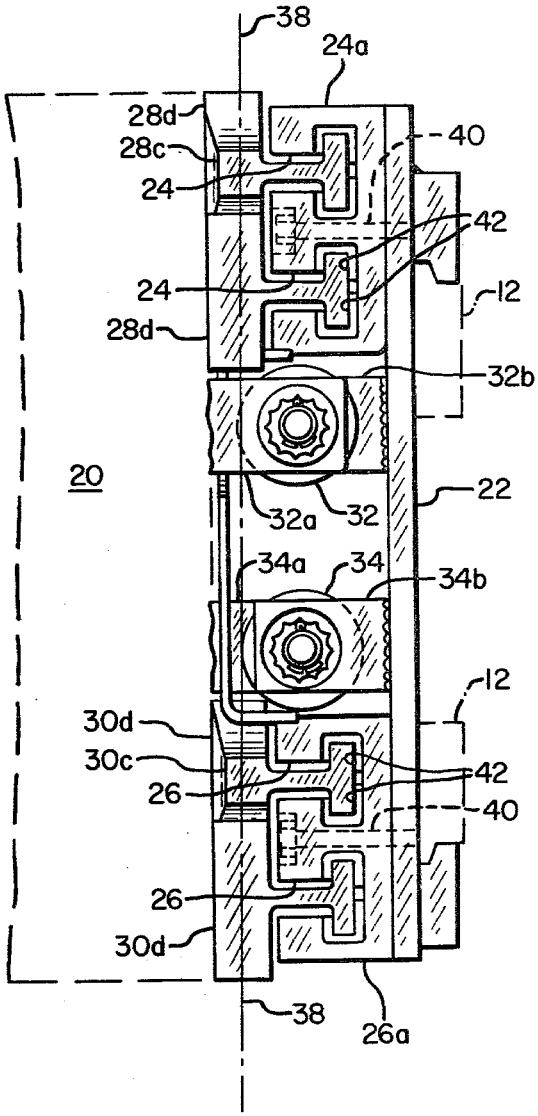
FIG. 4 is an end view of the slide structure taken along line 4—4 of FIG. 2.

With reference to FIGS. 2 and 4, movement of the respective slide members toward or away from one another is accomplished by means of double-acting hydraulic ram assemblies 32 and 34 respectively, the piston rod of ram assembly 32 being attached by a connecting member **32*a* to the load arm 20 and the piston rod of ram assembly 34 being attached by a connecting member 34*a* to the load arm 18. The cylinder portions of the oppositely facing ram assemblies 32 and 34 are connected to the slide guide frame 22 by means of respective connecting members 32*b* and 34*b*** respectively.

The configuration of each slide member 28 or 30 is designed to minimize stress concentration and resultant susceptibility to failure at the joint between the load arm and the slide member, and also to minimize the overall vertical height of the slide structure. Each slide member is of a modified horizontal I-beam configuration having a longitudinal rear portion **28*a* or 30*a* respectively (FIGS. 3 and 4), of substantially constant cross section throughout the length of the slide member, connected by a web 28*b* or 30*b* respectively to a longitudinal front portion external of the respective slide guide 24 or 26 respectively. The front portion of each slide member comprises a composite of a relatively narrow elongate section 28*c* or 30*c* respectively, extending longitudinally preferably along the majority of the length of the respective slide member, and an enlarged section 28*d* or 30*d* respectively at the load arm-mounting end of the slide member having a vertical dimension considerably greater than that of the narrow section 28*c* or 30*c*. Each enlarged section has a generally vertical, flat surface such as 28*d*' or 30*d*' (FIG. 2) which may or may not include apertures such as 36**, depending upon whether the load arms are to be bolted to these surfaces or welded thereto as discussed hereafter.

Figure 3:
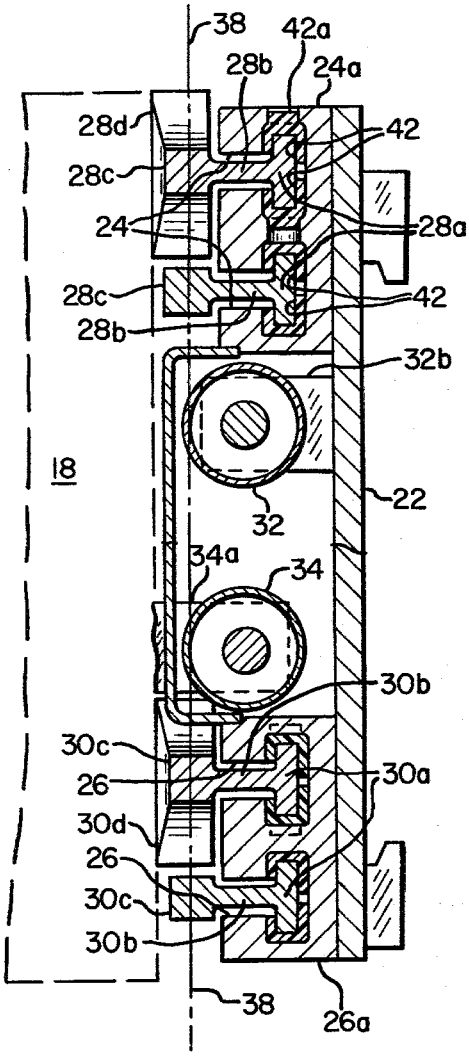
FIG. 3 is a cross section of the slide structure taken along line 3—3 of FIG. 2.

It is important to note that the narrow front sections such as **28*c* of each mutually adjacent pair of slide members such as 28, and the enlarged front sections such as 28*d* of such mutually adjacent pair of slide members, all intersect a common vertical plane such as that indicated by line 38 in FIGS. 3 and 4**. This is dictated by the requirement that there be no abrupt change in horizontal cross-sectional dimension of each slide member throughout the length of the front portion of the slide member so as to eliminate the usual stress concentration point in most previous slide structures caused by the forwardly protruding connecting member heretofore described upon which the load arm is typically mounted.

The major requirements for a slide structure having sufficient resistance to failure at the joint between the slide members and load arms and having the necessary range of travel for handling a wide variety of load sizes may be summarized as follows: (a) the front portions of each respective pair of adjacent slide members should extend longitudinally a considerable distance and intersect a common vertical plane to prevent horizontal stress concentrations; (b) the front portion of the slide member should be provided with a rather substantial vertical dimension to provide a large enough surface upon which the load arm can be mounted to form a sufficiently strong bolted or welded joint; and (c) the slide members must longitudinally overlap one another through at least a portion of their range of travel, especially when the load arm-mounting ends of the slide members are brought together within the width of the slide guide frame. If the front portions of the slide members were of uniform cross section, then in order to satisfy all of these requirements a considerable vertical distance would normally be required to contain the pair of slide members to ensure that the front portions of the slide members do not interfere with one another when in longitudinally overlapping relationship. This potential problem is obviated by the present invention, thereby minimizing the resultant vertical height of the slide structure, by virtue of the composite narrow section—enlarged section configuration of the front portion of each slide member wherein the cross-sectional dimension in a vertical plane such as 38 of the front portion of each slide member is markedly nonuniform along the length thereof, and also by virtue of the fact that the enlarged sections at the opposite ends of adjacent slide members protrude vertically toward the adjacent slide member to obtain their enlarged vertical dimensions, thereby overlapping one another vertically in the vertical plane 38 as best seen in FIG. 4. The vertically overlapping or "nested" relationship is made possible by the narrow sections of the front portions of the slide members with which the enlarged portions become juxtaposed vertically when the enlarged sections are moved within the width of the slide guide frame longitudinally overlapping the opposite ends of the adjacent slide member as illustrated in FIG. 2. Thus, because of the unique configuration of the front portions of the slide members, it is seen that the vertical distance occupied by each pair of slide members is considerably less, in relation to the vertical dimension of the enlarged end section upon which the load arm is mounted, than would otherwise be the case if the composite structure of the narrow section and enlarged section were not utilized. The vertical distances occupied by each pair of adjacent slide members in turn determines the overall vertical height of the slide structure, which is reduced considerably without sacrificing the range of slide travel while retaining the desired large vertical dimensions of the front portions of the slide members for the attachment of the load arms thereto.

Preferably the enlarged end section of each slide member includes a portion, such as **28*e* or 30*e* respectively, of a gradually increasing vertical dimension from the narrow front section toward the enlarged section, the increase in vertical dimension extending both toward and away from the adjacent slide member to maximize the vertical dimensions obtainable on the respective enlarged sections for a given vertical space occupied by the slide members. The gradually increasing vertical dimension minimizes any stress concentration which might otherwise be susceptible to vertical forces imposed by the weight of the load on the slide members. Moreover, as best seen in FIG. 5, the portions 28*e* of the enlarged end sections also increase gradually in horizontal cross-sectional dimension from the narrow section toward the enlarged section. This horizontal increase is much more gradual than the increase in vertical dimension because of the aforementioned criticality of horizontal forces imposed by the load moment and clamping moment respectively and the concomitant undesirability of any stress concentration point susceptible to these forces caused by abrupt changes in horizontal cross-sectional dimension. The slight gradual increase in horizontal dimension toward the enlarged sections is useful however in providing a clearance between the rear surfaces of the load arms and the narrow front portions of opposing slide members under conditions where the slide members are in a longitudinally overlapping relationship with the load arms. which the load arms 18 and 20 can be attached to the slide members. Load arm 18 is attached by means of bolts 44 inserted through the enlarged sections of the slide member, while load arm 20** is attached by welding to the enlarged sections of the slide members.

It is noteworthy that each pair of slide guides 24 and 26 respectively comprise a pair of parallel channels for slidably mounting the rear portions of the slide members, both channels being defined by a single monolithic metal piece 24*a* and 26*a* respectively (FIGS. 3 and 4) common to both guides. This structure facilitates the close vertical spacing of the respective channels made possible by the vertically nestable composite configurations of the front portions of each pair of adjacent slide members. Each monolithic piece 24*a* and 26*a* respectively is connected to the remainder of the slide guide frame 22 preferably by bolts such as 40 extending from front to rear between the respective channels.

The interior surfaces of the slide guides are preferably lined with replaceable slide bearings 42, of a suitable material such as reinforced self-lubricating nylon, extending longitudinally along at least a portion of the slide guide from the end thereof where the load arm is connected. Stub portions such as 42*a* of the bearing material protrude into mating apertures in the walls of the guide channels to ensure that the bearing material does not slide longitudinally with the slide members.

The terms and expressions which have been employed in the foregoing abstract and specification are used therein as terms of description and not of limitation, and there is no intention, in the use of such terms and expressions, of excluding equivalents of the features shown and described or portions thereof, it being recognized that the scope of the invention is defined and limited only by the claims which follow.

What is claimed is:

1. A slide structure adapted to be mounted on an elevatable load carriage at the front of a lift truck for operating transversely openable and closable load arms of a load-handling attachment, said slide structure comprising a slide guide frame, adapted to be mounted vertically on the load carriage, having at least a pair of elongate, parallel, vertically-spaced transverse slide guides thereon, each of said guides mounting a respective one of a mutually adjacent pair of elongate, parallel, vertically-spaced slide members longitudinally movable alternatively toward or away from one another in a mutually overlapping longitudinal relationship, each of said slide members having a longitudinal rear portion movably mounted within a respective one of said guides and a longitudinal elongate front portion external of the respective guide fixedly connected to said rear portion so as to move longitudinally in unison therewith, each of said elongate front portions including a first elongate section, protruding forwardly from the respective guide and extending longitudinally along the respective slide member, and a second section fixedly connected to said first section so as to move longitudinally in unison therewith having an end located adjacent one longitudinal extremity of said slide member and also protruding forwardly from the respective guide, said second section having a vertical dimension greater than that of said first section and having a surface for the attachment of a load arm thereto, said second sections being located at opposite ends of said pair of slide members and protruding vertically from said respective first sections thereof toward the other of said pair of slide members, said slide members being in such close vertical proximity to each other that said respective second sections overlap one another vertically, said first and second sections respectively of said pair of slide members all intersecting a common longitudinal vertical plane, and means for moving said slide members with respect to one another into such longitudinally overlapping relation that each of said second sections is juxtaposed vertically in said common longitudinal vertical plane with the first section of the other of said pair of slide members and said end of each second section is overlapped longitudinally in said common longitudinal vertical plane by said first section of the other of said pair of slide members.

2. The slide structure of claim 1 wherein the second section of each of said pair of slide members includes a portion of gradually increasing vertical dimension from the first section of the respective slide member toward the second section thereof, the increase in said vertical dimension extending toward the other slide member.

3. The slide structure of claim 1 wherein the second section of each of said pair of slide members protrudes vertically from the first section of the respective slide member in a direction away from, as well as toward, the other slide member.

4. The slide structure of claim 3 wherein the second section of each of said pair of slide members includes a portion of gradually increasing vertical dimension from the first section of the respective slide member toward the second section thereof, the increase in said vertical dimension extending both toward and away from the other slide member.

5. The slide structure of claim 1 wherein each of said pair of slide members is free of any abrupt change in horizontal cross-sectional dimension throughout the length of said front portion of the slide member.

6. The slide structure of claim 1 wherein the horizontal cross-sectional dimension of each of said pair of slide members increases gradually from said first section toward said second section of said slide member.

7. The slide structure of claim 1 wherein said slide guide frame has respective upper and lower pairs of said slide guides thereon, each pair of slide guides mounting a respective pair of said mutually adjacent slide members, the second sections of the upper slide members of the respective pairs being in vertical alignment with one another and the second sections of the lower slide members of the respective pairs being in vertical alignment with one another.

8. The slide structure of claim 1 wherein each of said first sections has a length extending and intersecting said common longitudinal vertical plane throughout the majority of the length of the respective front portion of its respective slide member for longitudinally overlapping said end of the second section of the other of said pair of slide members.

9. The slide structure of claim 8 wherein said length of each of said first sections extends throughout the majority of the length of its respective slide member.

10. The slide structure of claim 8 wherein each of said first sections has a substantially uniform vertical dimension throughout its length.

11. A slide structure adapted to be mounted on an elevatable load carriage at the front of a lift truck for operating transversely openable and closable load arms of a load-handling attachment, said slide structure comprising a slide guide frame, adapted to be mounted vertically on the load carriage, having respective upper and lower pairs of elongate, parallel, vertically-spaced transverse slide guides thereon, each of said pairs of slide guides mounting a respective pair of mutually-adjacent, elongate, parallel, vertically-spaced slide members longitudinally movable alternately toward or away from one another in a mutually-overlapping longitudinal relationship, each of said slide members having a longitudinal rear portion movably mounted within a respective one of said guides and a longitudinal front portion external of the respective guide fixedly connected to said rear portion so as to move longitudinally in unison therewith, each of said longitudinal front portions extending longitudinally along the majority of the length of the respective slide member and including a first elongate section protruding forwardly from the respective guide and extending longitudinally along the respective slide member and a second section fixedly connected to said first section at one end of said front portion and also protruding forwardly from the respective guide, said second section having a vertical dimension greater than that of said first section, said second sections of said slide members having surfaces for the attachment of load arms thereto and being located at opposite ends of each of said pairs of slide members such that the second sections of the upper slide members of the respective pairs are in vertical alignment with each other and the second sections of the lower slide members of the respective pairs are in vertical alignment with each other, said second sections of each respective pair of slide members protruding vertically toward the other slide member of the respective pair, the slide members of each respective pair being in such close vertical proximity to each other that the second sections of the respective pair overlap one another vertically, the first and second sections respectively of all of said slide members all intersecting a common longitudinal vertical plane.

12. The slide structure of claim 11 wherein each of said slide members is free of any abrupt change in horizontal cross-sectional dimension throughout the length of said front portion of the slide member.

13. The slide structure of claim 11 wherein each of said second sections has an end located adjacent one longitudinal extremity of its slide member, further including means for moving the slide members of each of said pairs with respect to one another into such longitudinally overlapping relation that each of said second sections is juxtaposed vertically in said common longitudinal vertical plane with the first section of the other of the respective pair of slide members and said end of said second section is overlapped longitudinally in said common longitudinal vertical plane by the first section of the other of the respective pair of slide members.

14. The slide structure of claim 13 wherein each of said first sections has a length extending and intersecting said common longitudinal vertical plane throughout the majority of the length of its respective slide member for longitudinally overlapping said end of the second section of the other of the respective pair of slide members.

15. The slide structure of claim 14 wherein each of said first sections has a substantially uniform vertical dimension throughout its length.

* * * * *

UNITED STATES PATENT AND TRADEMARK OFFICE

CERTIFICATE OF CORRECTION

PATENT NO. : 4,185,944

DATED : January 29, 1980

INVENTOR(S) : Richard D. Seaberg

It is certified that error appears in the above-identified patent and that said Letters Patent are hereby corrected as shown below:

Col. 7, line 12 Before "which the load arms 18 and 20 can be attached to the", begin a new paragraph and insert the following --FIG. 5 illustrates two alternative methods by--.

Signed and Sealed this

*Thirteenth* Day of *May 1980*

[SEAL]

*Attest:*

SIDNEY A. DIAMOND

*Attesting Officer*

*Commissioner of Patents and Trademarks*